US007454813B2

(12) United States Patent
Kaltenegger

(10) Patent No.: US 7,454,813 B2
(45) Date of Patent: Nov. 25, 2008

(54) CLEANING DEVICE AND METHOD

(75) Inventor: Helmut Kaltenegger, New Street of Bay Junction, STJ 15, St. Julians (MT)

(73) Assignee: Helmut Kaltenegger, Malta (AT)

( * ) Notice: Subject to any disclaimer, the term of this patent is extended or adjusted under 35 U.S.C. 154(b) by 818 days.

(21) Appl. No.: 10/942,472

(22) Filed: Sep. 16, 2004

(65) Prior Publication Data

US 2006/0037166 A1 Feb. 23, 2006

(30) Foreign Application Priority Data

Aug. 23, 2004 (DE) ..... 20 2004 013 199 U

(51) Int. Cl.
*A47L 25/00* (2006.01)
*A47L 13/42* (2006.01)

(52) U.S. Cl. ..... 15/244.1; 15/210.1

(58) Field of Classification Search ..... 15/244.1, 15/244.3, 244.4, 210.1
See application file for complete search history.

(56) References Cited

U.S. PATENT DOCUMENTS 3,611,468 A 10/1971 Michael et al.
3,857,133 A * 12/1974 Linenfelser ..... 15/118
4,111,666 A * 9/1978 Kalbow ..... 51/295
5,312,197 A * 5/1994 Abramson ..... 401/6
5,640,737 A * 6/1997 Boggs ..... 15/118
6,485,822 B1 * 11/2002 Osiecki et al. ..... 428/316.6
6,687,941 B2 * 2/2004 Billat ..... 15/220.1
7,284,293 B1 * 10/2007 Holder et al. ..... 15/104.94
2003/0094186 A1 * 5/2003 Klein ..... 134/6

FOREIGN PATENT DOCUMENTS

DE 8714649.5 11/1987
DE 4330357 A1 9/1993
DE 20100071 U1 1/2001
DE 20209565 U1 6/2002
DE 10327584 A1 6/2003

* cited by examiner

*Primary Examiner*—David B Thomas
(74) *Attorney, Agent, or Firm*—Muirhead and Saturnelli, LLC

(57) ABSTRACT

A cleaning device includes a soft sponge layer, having at least one rib or bead on its surface; an intermediate layer, which is harder than the sponge layer, a cloth layer, that is bonded to the intermediate layer, opposite to the sponge layer. The layers may be bonded to one another. Bonding the soft sponge layer to a harder intermediate layer already considerable improves upon the handling achieved by the sponge with the rib. Even when the sponge is completely soaked with the cleaning agent it remains stable in shape due to its firm bonding to the harder intermediate layer. The user may grasp the hard intermediate layer of the device so that the sponge will not be compressed.

12 Claims, 2 Drawing Sheets

CLEANING DEVICE AND METHOD

FIELD OF THE INVENTION

The present invention relates to a cleaning device and method, especially for electronic devices with a keyboard, and further to a cleaning set comprising packaging enclosing such device and a container with a cleaning agent.

BACKGROUND OF THE INVENTION

Different cleaning sets have been offered for cleaning electronic devices with a keyboard, especially for cleaning desktop and laptop computers. The most simple of such cleaning sets comprises a cleaning agent, preferably an alcohol-free surface cleaner for glass, metal or plastics, and several soft cloths. The cleaning agent is usually contained in containers with a volume of 100 to 250 ml. The container has a pump and spray head for applying the cleaning agent to a cloth. Dirt is dissolved and removed by wiping over the soiled surface.

It has been shown in practice that the keyboards of electronic devices such as computers as well as the keyboards of telephones, calculators and other devices may only be insufficiently cleaned by means of simple cloths. In particular, it is difficult to remove dirt in the gaps between two keys. For this reason, relatively soft sponges with several ribs extending parallel to each other have been proposed. These sponges are advantageous for cleaning keyboards. When a rib meets a gap between two keys it penetrates into this gap and cleans the surfaces in the region of this gap. When a rib meets a key it is simply compressed and does not interfere with the cleaning operation. The sponge material must be relatively soft in order to provide optimum cleaning of the gaps between keys. The sponge material softens further when the sponge is soaked with the cleaning agent. Thus, the sponge is relatively unstable in shape and difficult to handle. Additionally, upon grasping of the sponge, cleaning agent is squeezed out and may touch the hand of the user. This is undesirable, especially when the user's fingernails are covered with nail polish.

Further, it is not possible with the sponge to completely remove a liquid such as the cleaning agent from a surface. The soft sponge with the ribs is thus not suited for cleaning flat surfaces, especially the display screen of an electronic device.

Additionally, it is inconvenient to transport the known cleaning sets with cloths, sponges and a cleaning agent in a container since they have multiple parts and take up a great deal of space. In most cases users thus avoid cleaning their electronic devices while traveling.

Accordingly, it is desirable to provide a cleaning device and a cleaning set comprising such device which are easy to handle for cleaning electronic devices and which are easy to transport.

SUMMARY OF THE INVENTION

A cleaning device according to one embodiment of the invention comprises the following layers firmly bonded to one another: a soft sponge layer, having at least one rib or bead on its surface; an intermediate layer, which is harder than the sponge layer, a cloth layer, that is bonded to the intermediate layer, opposite to the sponge layer.

Bonding the soft sponge layer to a harder intermediate layer already considerable improves upon the handling achieved by the sponge with the rib. Even when the sponge is completely soaked with the cleaning agent it remains stable in shape due to its firm bonding to the harder intermediate layer.

The user is most likely to grasp the hard intermediate layer of the device of the invention so that the sponge will not be compressed.

The cloth layer opposite the sponge layer additionally allows the cleaning device to be used for cleaning display screens. The cloth layer also maintains its shape by means of the intermediate layer to which it is bonded.

In practice the intermediate layer may include a flat body. The first flat surface of said flat body comprises the sponge and the opposite, second flat surface comprises the cloth. In practice, this intermediate layer may be light and porous in order to reduce the weight of the cleaning device. The intermediate layer is preferably composed of dimensionally stabile foamed plastics material, i.e. a plastic foam which holds its shape.

The sponge layer may be laminated to the intermediate layer. For laminating, at least one of the surfaces to be bonded is melted and the two surfaces are then brought into contact. Upon cooling of the melted surface region the foamed plastics of the sponge layer and the intermediate layer are firmly bonded. In practice the cloth layer may be glued onto the second surface of the intermediate layer.

The intermediate layer may also be composed of other materials, for example a composite material with a honeycomb structure or a plate made of lightweight plastics or wood. In this case the bonding between the intermediate layer and the sponge layer can be achieved by means of an adhesive.

In order to reach optimum cleaning results the surface of the sponge layer has several ribs or beads that extend parallel to one another. In a first embodiment the surface of the sponge has rounded beads extending parallel to one another. A cross-section of said surface of the sponge layer has a waved shape. The height of the beads i.e. the distance between the peak and the trough of the wave form of the surface in a cross-sectional view, is in the order of 5 mm. This embodiment is particularly appropriate for cleaning the keyboards of laptop computers with flat keys. This embodiment can also be used for cleaning other electronic devices with flat keys, such as desktop telephones or mobile telephones.

In an alternative embodiment the surface of the sponge layer has ribs extending parallel to one another. The ribs have a height of approx. 10 mm, for example. Such ribs are particularly suitable for cleaning the keyboards of desktop computers having deep gaps between the separate keys. The gaps between keys of desktop computers are usually wedge-shaped. The ribs of the sponge layer may be rectangular so that they are squeezed in a transverse direction when penetrating into a gap between two keys. This increases the surface pressure between the surface of the sponge and the surface of the keys. This also causes cleaning agent in the sponge to emerge to its surface which enhances the cleaning effect.

The distance between two parallel ribs or beads may be more than 5 mm, preferably in the order of 10 to 20 mm. The distance does not necessarily have to correspond to the width of the keys of a keyboard as it differs for different devices and usually lies in the range of 10 to 20 mm. In practice it is sufficient if only one of several ribs or beads penetrates into a gap between two keys during cleaning. However, it is also possible to adapt the distance between two ribs to the width of the keys of a specific device. For the keyboards of common desktop computers 19 mm may be chosen as the distance between two ribs, i.e. the common width of keys of desktop keyboards.

The cloth layer may include any cloth that ensures optimum cleaning of the surface of a screen. For example, a leather cloth which effectively removes liquids like a cleaning agent from glass surfaces may be suitable.

However, when cleaning plastics surfaces of an LCD display, high friction between a leather cloth and the surface of the monitor may cause problems. For this reason fibrous cloths may be used in practice for cleaning synthetic surfaces of displays. In particular, microfiber cloths or cloths of thin random webs may be bonded to the intermediate layer in order to form the cloth layer of the cleaning device.

The cleaning device with the sponge layer having ribs or beads on one side and the cloth layer on the other side should have handy dimensions. In practice a width in the range of 40 to 80 mm, a length in the range of 60 to 120 mm and a thickness in the range of 15 to 40 mm have proven to be suitable. A cleaning device with a waved sponge surface for cleaning laptop computers will be thinner than a cleaning device with a ribbed sponge surface for cleaning desktop keyboards since the beads of the waved sponge are flatter than the ribs of the sponge for cleaning desktop keyboards.

In practice it has been found that a flexible foam made of polyurethane (PUR) with an apparent density of approximately 20 to 30 kg/m$^3$ and a compression stress value CV40 of less than 10 kPa, preferably about 5 kPa has very good cleaning properties for keyboards. Said compression stress value CV40 is a standardized value in accordance with the international standard ISO 3386/1-1986 for the resistance of foamed plastics against a compression of 40%.

The intermediate layer is considerably harder and can largely vary. The intermediate layer may, for example, have a very stiff, wood-like structure. However, a foamed plastic material may be used for the intermediate layer in order to reduce weight. In practice a polyethylene (PE) foam with a closed cell structure and an apparent density in the region of 40 to 60 kg/m$^3$ and a compression stress value CV40 in the region of 50 to 150 kPa has proven to be suitable to form the intermediate layer.

As mentioned above, the invention also relates to a cleaning set comprising packaging and a cleaning agent in a container. According to this embodiment of the invention, the cleaning set comprises a cleaning device as described above which is contained in the packaging together with the container for the cleaning agent.

Any suitable material such as paper, cardboard or plastics may be used for the packaging. Plastic packaging is preferred for weight reasons. If the cleaning set is designed for multiple use, the plastic packaging may be reclosable. Simple blister packaging or plastic foils wrapped and welded around the contents may also be used for packaging the cleaning device and the container with the cleaning agent. In practice the packaging may be of a transparent plastic material so that its content may be seen by the consumer.

The container may have a manually activated pump and spray head for dispensing the cleaning agent to the surface of the sponge layer or the cloth layer. The container for the cleaning agent is a so called non-aerosol or pump spray. It comprises an ascending pipe for the liquid in the container and a pump and spray head, that may be pushed into the container. By pushing the pump and spray head into the container the volume of the container is reduced and the pressure inside the container is increased. The increased pressure urges the cleaning agent to rise through the ascending pipe to the spray diffuser in the pump and spray head. The cleaning agent exits the spray diffuser as a uniform spray fog and may thus be evenly applied to the sponge surface or cloth surface of the cleaning device.

Alcohol-free surface cleaners have proven to be suitable cleaning agents in practice.

The quantity of cleaning agent in the container may be 2 to 20 ml, for example. Thus, the container is considerably smaller than known cleaning agent containers. The cleaning set is intended for a single or a few cleaning operations of electronic devices so that the quantity of 2 to 20 ml of the cleaning agent is sufficient. Due to the small size of the container, the cleaning set according to the invention is very compact and may be put in any pocket.

BRIEF DESCRIPTION OF THE DRAWINGS

Embodiments of the invention will be described hereinafter with references to the attached drawings, in which.

DETAILED DESCRIPTION OF VARIOUS EMBODIMENTS

Figure 1:
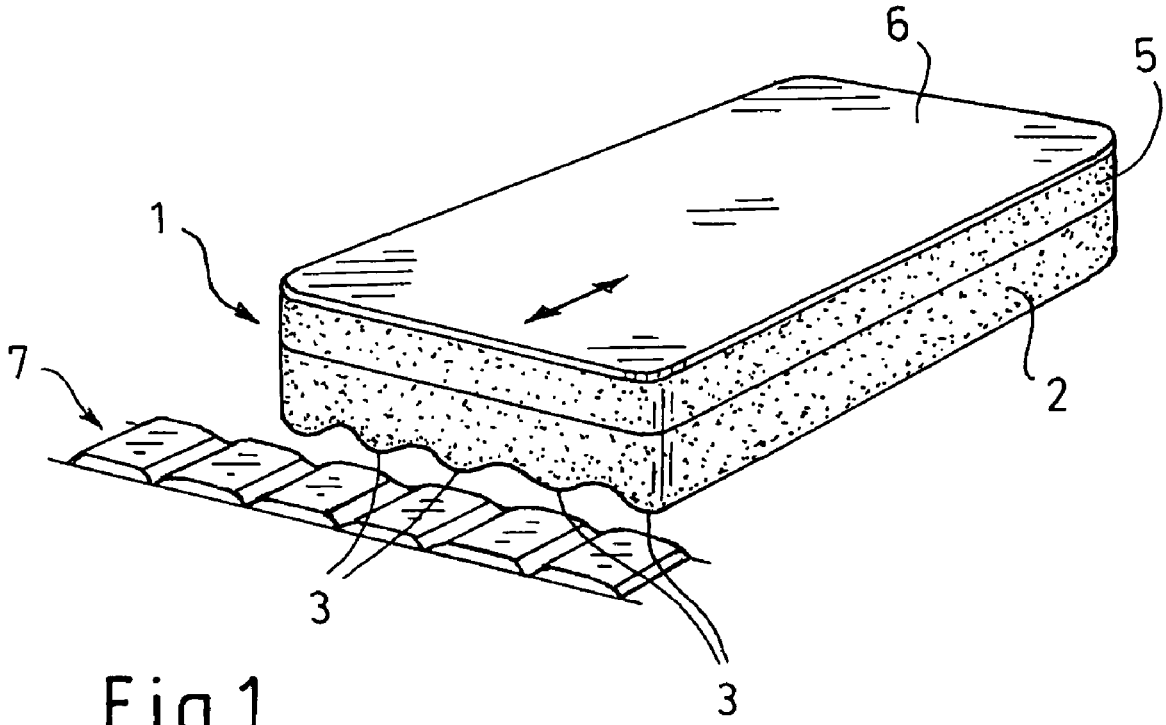
FIG. 1 shows a perspective view of a cleaning device according to one embodiment of the invention with beads on the sponge surface.

The cleaning device shown in FIG. 1 includes a lower flexible sponge layer 2. The lower surface of the sponge layer has several beads 3 extending in the longitudinal direction and parallel to one another. The lower surface of the sponge layer 2 has a waved shape in cross section. The sponge layer 2 includes a flexible foam made of polyurethane (PUR) with an apparent density of approx. 21 kg/m$^3$ and a compression stress value CV40 (ISO 3386-1) of approx. 5 kPa.

An intermediate layer 5 is disposed on top of the sponge layer. The intermediate layer 5 is considerably harder than the sponge layer 2. The intermediate layer 5 includes a polyethylene (PE) foam with a closed cell structure and a specific weight of approx. 45 kg/m$^3$. The compression stress value CV40 (ISO 3386-1) amounts to approx. 90 kPa. The value of the indentation hardness is listed as shore hardness 00 scale (min 10 mm c/c thickness), test method ISO 868 1985, BS 2782: Pt3, Method 365B: 1992 and amounts to 62. This material provides the intermediate layer having a thickness of approx. 10 mm with a relatively stiff structure stable in shape. The material of the intermediate layer is only slightly deformed by the usual forces applied during the cleaning process, but is sufficiently flexible to avoid damage to the device to be cleaned.

The sponge layer 2 and the intermediate layer 5 are bonded by laminating. At least one of the surfaces of these layers is melted and brought into contact with the second surface for bonding.

A cloth layer 6 is glued onto the top surface of the intermediate layer 5. The cloth layer 6 includes a microfiber cloth made of polyester, also known as PES interlock. It has a mass per unit area of approx. 160 g/m$^3$.

The firm and hard intermediate layer 5 stabilizes the sponge layer 2. The sponge layer 2 can therefore only be compressed in a direction perpendicular to its main plane. This stabilizing effect is of special importance when the sponge layer is softened due to soaking with a cleaning agent. The same applies to the cloth layer 6 which, due to the bonding of the hard intermediate layer to the entire top surface, is stretched in one plane. The cloth layer 6 may be used for cleaning the flat surfaces and especially the display screen of an electronic device. For this purpose, a cleaning agent may be sprayed on the cloth layer 6 and subsequently the flat surface of the electronic device may be wiped with the cloth layer 6. Alternatively, the cleaning agent may be sprayed onto the sponge layer 2 for wiping the flat surface. Subsequently the cleaning agent may be wiped off the flat surface with the cloth layer 6.

The cleaning device 1 will be grasped by the user at the hard intermediate layer 5 both for cleaning with the cloth layer 6 and for cleaning with the sponge layer 2. This avoids contact of the hands, fingers or fingernails of the user with the cleaning agent or the removed dirt on the cloth layer 6 or the sponge layer 2. The hard intermediate layer 5 allows a firm grip and secure guidance of the cleaning device 1.

The sponge layer 2 shown in FIG. 1 with the rounded beads 3 is especially suitable for cleaning the keys of the keyboard of a laptop computer. One row of keys 7 of a laptop keyboard is shown in FIG. 1. When pressing the cleaning device 1 on the row of keys 7 at least one of the beads 3 will be inserted into a gap between two keys of the row of keys 7. For cleaning purposes a cleaning agent will be sprayed onto the lower surface of the sponge layer 2. Subsequently, the sponge layer 2 will be wiped over the keyboard in the direction of the arrows shown in FIG. 1.

Figure 2:
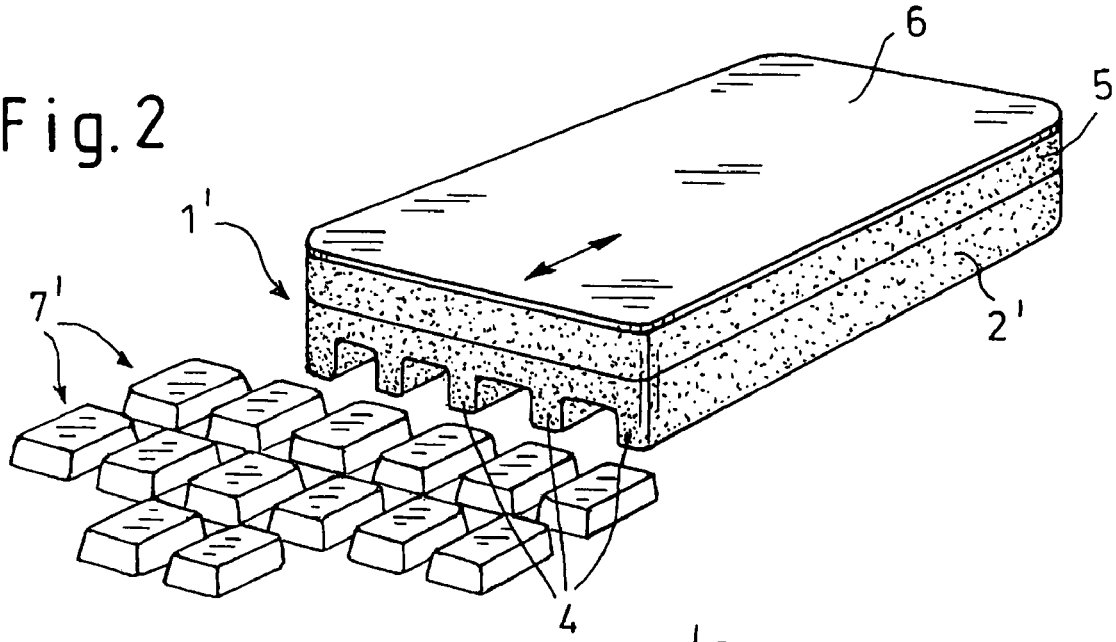
FIG. 2 shows a perspective view of a second embodiment of a cleaning device.

FIG. 2 shows an alternative embodiment of the cleaning device 1', which also comprises an upper cloth layer 6, a hard intermediate layer 5 and a lower sponge layer 2'. The cloth layer 6 is generally intended for screen cleaning as described above.

The sponge layer 2' is intended for cleaning a keyboard. The sponge layer 2' of the embodiment shown in FIG. 2 has rectangular ribs 4 that extend parallel to one another and in the longitudinal direction of the cleaning device 1'. Whereas the beads 3 over the first embodiment (see FIG. 1) have a height of approx. 5 mm, the ribs 4 of the embodiment in FIG. 2 have a height of approx. 10 mm. These ribs 4 penetrate the gaps between the keys of a conventional PC-keyboard. FIG. 2 shows several rows 7 of keys of such keyboard. It can be seen that the flanks of the separate keys are tilted so that the gaps between two adjacent keys are tapered. The ribs 4 have a rectangular shape so that their corners or edges are compressed when penetrating into a gap between two keys. This increases the contact pressure between the surfaces of the foam material of the ribs 4 and the surfaces of the flanks of the keys. The result is a better cleaning action. Additionally, the cleaning agent which is absorbed in the sponge layer 2 in the region of the ribs 4 will emerge due to the compression of the ribs 4. This additionally enhances cleaning of the surfaces of the keys.

Figure 3:
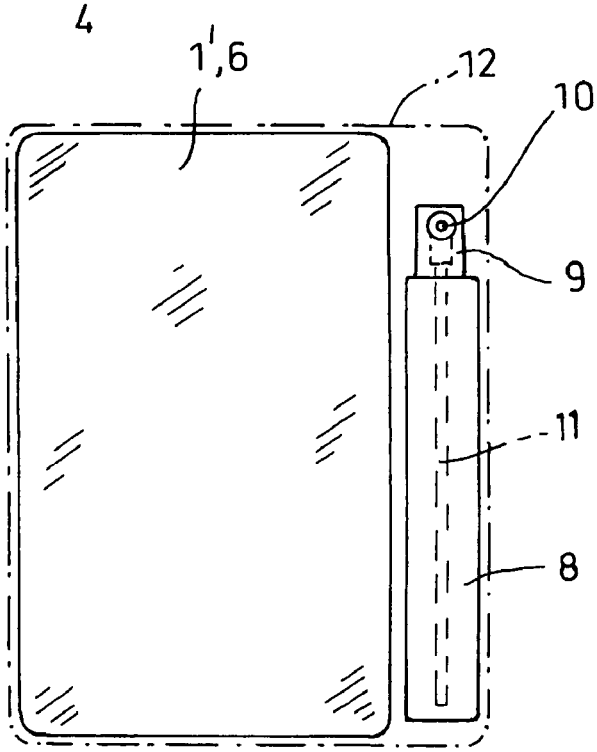
FIGS. 3 and 4 show a top view and a front view of a cleaning set having a cleaning device of the invention.
Figure 4:
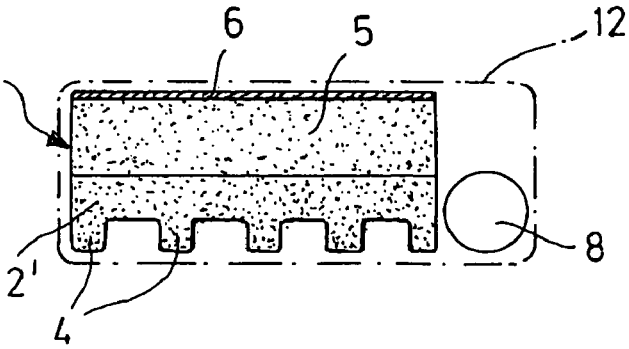

FIGS. 3 and 4 show a cleaning set of the invention which comprises a cleaning device 1' of FIG. 2 as a component. Additionally, the cleaning set comprises a container 8 with a cleaning agent. The container 8 and the cleaning device 1' are held in a common packaging 12. The packaging 12 is a simple box made of plastic material and is represented in FIGS. 3 and 4 by dotted lines. As an alternative, the packaging 12 may consist of a transparent synthetic foil which is wrapped and welded around the components of the cleaning set.

As shown in FIG. 3, the container with the cleaning agent is a non-aerosol pump spray. It has a pump and spray head 9 with a spray diffuser 10. An ascending pipe 11 leads from the spray diffuser 10 into the inside of the container 8 near its bottom. The ascending pipe 11 is represented by dotted lines. Manual pressure on the pump and spray head 9 moves said head into the container 8 and increases the pressure inside said container 8. The increased pressure urges the cleaning agent through the ascending pipe 11 to the spray diffuser 10 where it exits as a spray fog. By means of this pump spray the cleaning agent may be evenly distributed over the surface of the sponge layer 2' or the surface of the cloth layer 6.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

The invention claimed is:

1. A cleaning device, comprising the following layers firmly bonded to one another:

a soft sponge layer, having at least one of: a rib and a bead on its surface;

an intermediate layer, which is harder than the sponge layer and a cloth layer which is bonded to the intermediate layer opposite to the sponge layer.

2. The cleaning device of claim 1, wherein the surface of the sponge layer comprises a multitude of ribs extending parallel to one another.

3. The cleaning device of claim 1, wherein the surface of the sponge layer comprises a multitude of beads extending to one another.

4. The cleaning device of claim 1, wherein the intermediate layer is composed of foamed plastics which is considerably harder than the sponge layer.

5. The cleaning device of claim 1, wherein the cloth layer includes at least one of: glass cleaning cloth, plastics cleaning cloth, microfiber cloth, random web cloth.

6. The cleaning device of claim 1, wherein the cleaning device has a width in the range of 40 mm to 80 mm, a length in the range of 60 mm to 120 mm and a thickness in the range of 15 mm to 40 mm.

7. The cleaning device of claim 1, wherein a compression stress value CV40 (ISO 3386/1) of the flexible foam of the sponge layer is in the range of 2 to 10 kPa.

8. The cleaning device of claim 1, wherein the compression stress value CV40 (ISO 3386/1) of the intermediate layer is in the range of 50 to 150 kPa.

9. A cleaning set comprising packaging enclosing a container with a cleaning agent and a cleaning device comprising the following layers firmly bonded to one another:

a soft sponge layer, having at least one of: a rib and a bead on its surface;

an intermediate layer, which is harder then the sponge layer and a cloth layer which is bonded to the intermediate layer opposite to the sponge layer.

10. The cleaning set of claim 9, wherein the container comprises a pump and spray head for manual operation.

11. The cleaning set of claim 9, wherein the cleaning agent is an alcohol-free surface cleaner.

12. The cleaning set of claim 9, wherein the volume of the container is in the range of 2 to 20 ml.

* * * * *